US007654112B2

(12) United States Patent
Pons

(10) Patent No.: US 7,654,112 B2
(45) Date of Patent: Feb. 2, 2010

(54) JEWELRY FORMING ARTICLE AND METHOD

(75) Inventor: Luis G. Pons, Miami, FL (US)

(73) Assignee: Aponwao Design Inc., Washington, DC (US)

( * ) Notice: Subject to any disclaimer, the term of this patent is extended or adjusted under 35 U.S.C. 154(b) by 565 days.

(21) Appl. No.: 11/493,674

(22) Filed: Jul. 27, 2006

(65) Prior Publication Data

US 2007/0095101 A1 May 3, 2007

Related U.S. Application Data

(60) Provisional application No. 60/732,708, filed on Nov. 3, 2005.

(51) Int. Cl.
*A44C 25/00* (2006.01)

(52) U.S. Cl. ..... 63/41; 63/3.1; 63/4; 63/21; 63/33; 63/900

(58) Field of Classification Search ..... 63/1.11, 63/1.16, 1.18, 3, 3.1, 3.2, 4, 33, 38, 41, 900
See application file for complete search history.

(56) References Cited

U.S. PATENT DOCUMENTS

| | | | | |
|---|---|---|---|---|
| 439,139 | A | 10/1890 | Gaynor | |
| 690,095 | A | 12/1901 | Bleaden | |
| 1,182,534 | A | 5/1916 | Driggott | |
| 2,508,147 | A | 5/1950 | Dutch | |
| 4,095,587 | A | 6/1978 | Ishikawa | |
| 4,530,221 | A * | 7/1985 | Weinberg | 63/3.2 |
| 5,195,335 | A | 3/1993 | Hart | |
| 5,307,582 | A | 5/1994 | Quintel | |
| 5,535,603 | A * | 7/1996 | Hayakawa | 63/3 |
| 5,806,346 | A | 9/1998 | Schlinger et al. | |
| 6,427,486 | B1 * | 8/2002 | Yellen | 63/3 |
| 6,612,130 | B2 * | 9/2003 | Ito | 63/3 |
| 6,715,315 | B1 | 4/2004 | Hartgrove | |
| 6,729,159 | B2 | 5/2004 | Rose | |

(Continued)

FOREIGN PATENT DOCUMENTS

| | | |
|---|---|---|
| JP | 2002142820 | 5/2002 |

OTHER PUBLICATIONS

Notification of Transmittal of the International Search Report and the Written Opinion of the International Search Authority, or the Declaration, International Patent Application No. PCT/US2006/40734, Filed Oct. 18, 2006, Date of Mailing: May 18, 2007.

*Primary Examiner*—Jack W. Lavinder
(74) *Attorney, Agent, or Firm*—DLA Piper LLP (US)

(57) ABSTRACT

A jewelry forming article utilizes free magnetic bodies and free deformable chains to form various jewelry objects, such as rings, bracelets, necklaces, and the like. The various jewelry objects are formed by magnetically engaging the surfaces of the free magnetic bodies to two or more regions along a length of the deformable free chains, forming one or more loop circumferences along the length of the chains between the engaging regions, where the loop circumference may be increased or decreased by changing the positions of the engaging regions relative to the surfaces of the magnetic bodies to enable a person to secure the article on his or her body in the form of the various jewelry objects.

22 Claims, 7 Drawing Sheets

U.S. PATENT DOCUMENTS

| | | | | |
|---|---|---|---|---|
| 6,962,063 | B1 * | 11/2005 | Pearl | 63/3.2 |
| 7,371,472 | B2 * | 5/2008 | Fukuda | 428/693.1 |
| 2004/0111005 | A1 | 6/2004 | Lu | |
| 2004/0194503 | A1 * | 10/2004 | Schnitman | 63/3.2 |
| 2004/0200235 | A1 | 10/2004 | Kretchmer | |
| 2004/0200236 | A1 * | 10/2004 | Emberson et al. | 63/23 |
| 2005/0138963 | A1 | 6/2005 | Williams | |
| 2006/0048543 | A1 * | 3/2006 | Kessler | 63/40 |

* cited by examiner

JEWELRY FORMING ARTICLE AND METHOD

CROSS REFERENCE TO RELATED APPLICATIONS

This application is based on, and claims priority to, U.S. Provisional Application Ser. No. 60/732,708, filed Nov. 3, 2005, the entire contents of which are hereby incorporated by reference.

BACKGROUND OF THE INVENTION

1. Field of the Invention

The invention relates generally to jewelry, and more specifically to a jewelry forming article which can be arranged into a number of different jewelry objects by manipulation of the engagement between a free body fabricated from magnetized material and a free length of chain.

2. Background Information

It is often desired to be able to change the style of a piece of jewelry. A wearer may become bored having a single, unchangeable piece of jewelry, or may desire to have a versatile piece of jewelry which can be modified according to dress or occasion. Alternatively, the wearer might desire to change the type of jewelry to match the style, preferring a necklace to a bracelet without the purchase of separate jewelry to achieve these fashion goals.

Several devices that allow for the removal and replacement of ornaments from jewelry are known. For example, U.S. Pat. No. 439,139 to Gaynor describes a setting for coins to be worn as a pin or brooch. U.S. Pat. No. 690,095 to Bleaden teaches a ring having a removable stone and a sliding door that fits behind the stone and secures it to the ring. U.S. Pat. No. 1,182,534 to Driggott describes a gem setting for a ring.

While these devices allow for removable and replaceable ornaments (coins, stones, gems, etc.), none of them allow the type of jewelry to be changed. Typical in the art are bands which can be modified to form different types of jewelry objects such as bracelets, watches, collars, anklets, and the like. These devices employ various mechanical means to achieve the desired band circumferences. For example, see U.S. Pat. No. 2,508,147. Such devices have the disadvantage of being mechanically complex, and thus, prone to failure.

Magnetism has been used to overcome some of the problems typically associated with mechanical means for adjustment. For example, Quintel (U.S. Pat. No. 5,307,582) describes an adjustable band which allows for adjustment of band circumference using magnets. Further, Hartgrove (U.S. Pat. No. 6,715,315) discloses interchangeable settings for various body portions of jewelry such as ring composites.

However, these and other devices require the magnetized component of the device to be integral within either the body of the jewelry itself or to serve simply as a clasping means to hold together various components that make up the jewelry device (e.g., U.S. Pat. No. 6,729,159 or JP2002142820).

These inventions then, while making exchange of magnetically attachable ornamental pieces or providing a means to replace mechanically dependent variations in length or circumference, do not provide the versatility to change a jewelry object from a necklace to a ring or vice versa. In other words, the wearer is limited basically to the same jewelry object.

SUMMARY OF THE INVENTION

The present invention relates to jewelry articles having free magnetic bodies and free chains that allow the wearer to change jewelry from one type of jewelry object to another.

In one embodiment, a jewelry-forming article includes a first component having one or more free magnetic bodies and a second component comprising one or more free deformable chain lengths, where one or more surfaces of the magnetic bodies magnetically engage one or more regions along the length of the chain enabling a person to secure the article on the body of the person.

In a related aspect, surfaces of the magnetic bodies define a standard or irregular geometric solid, including spheres, cubes, cylinders, cones, prisms, pyramids, tetrahedrons, octahedrons, and dodecahedrons.

In another embodiment, a jewelry-forming article includes a first component comprising a free magnetic body and a second component comprising one or more free deformable chain lengths, where one or more surfaces of the magnetic body magnetically engage one or more regions along the length of the chains, and wherein non-engaging regions along the length of the chains form loops which enables a person to secure the article on his or her body.

In still another embodiment, a method of wearing a jewelry article includes magnetically engaging one or more surfaces of one or more free magnetic bodies to two or more regions along a length of one or more free chains, thereby forming at least one loop along the length of the chains between the engaged regions, where at least one loop enables a person to secure the article on the body of the person.

Exemplary methods and compositions according to this invention, are described in greater detail below.

BRIEF DESCRIPTION OF THE DRAWINGS

The foregoing summary, embodiments, and other aspects of the present invention will be best understood with reference to a detailed description of specific embodiments of the invention, which follows, when read in conjunction with the accompanying drawings. In the drawings, closely related figures have the same number.

DETAILED DESCRIPTION OF THE INVENTION

Before the present composition, methods, and articles are described, it is to be understood that this invention is not limited to particular compositions, methods, and articles described, as such compositions, methods, and articles may vary. It is also to be understood that the terminology used herein is for purposes of describing particular embodiments only, and is not intended to be limiting, since the scope of the present invention will be limited only in the appended claims.

As used in this specification and the appended claims, the singular forms "a", "an", and "the" include plural references unless the context clearly dictates otherwise. Thus, for example, references to "the method" includes one or more methods, and/or steps of the type described herein which will become apparent to those persons skilled in the art upon reading this disclosure and so forth.

Unless defined otherwise, all technical and scientific terms used herein have the same meaning as commonly understood by one of ordinary skill in the art to which this invention belongs. Any methods and materials similar or equivalent to those described herein can be used in the practice or testing of the invention, as it will be understood that modifications and variations are encompassed within the spirit and scope of the instant disclosure. All publications mentioned herein are incorporated herein by reference in their entirety.

As used herein, "free," including grammatical variations thereof, means not fastened or permanently fix to a particular position or place. In a related aspect, one or more magnetic bodies and one or more chain lengths are free from one another, unless engaged magnetically.

In a further related aspect, one or more free magnetic bodies may be joined together or fixed to one or more other magnetic bodies, to produce, for example, dumbbell-shaped magnetic bodies, triangular magnetic bodies, tetrahedral magnetic bodies, cubic magnetic bodies, and the like, yet such magnetic bodies remain free of the one or more chain lengths, unless engaged with the chain lengths magnetically.

Figure 1:
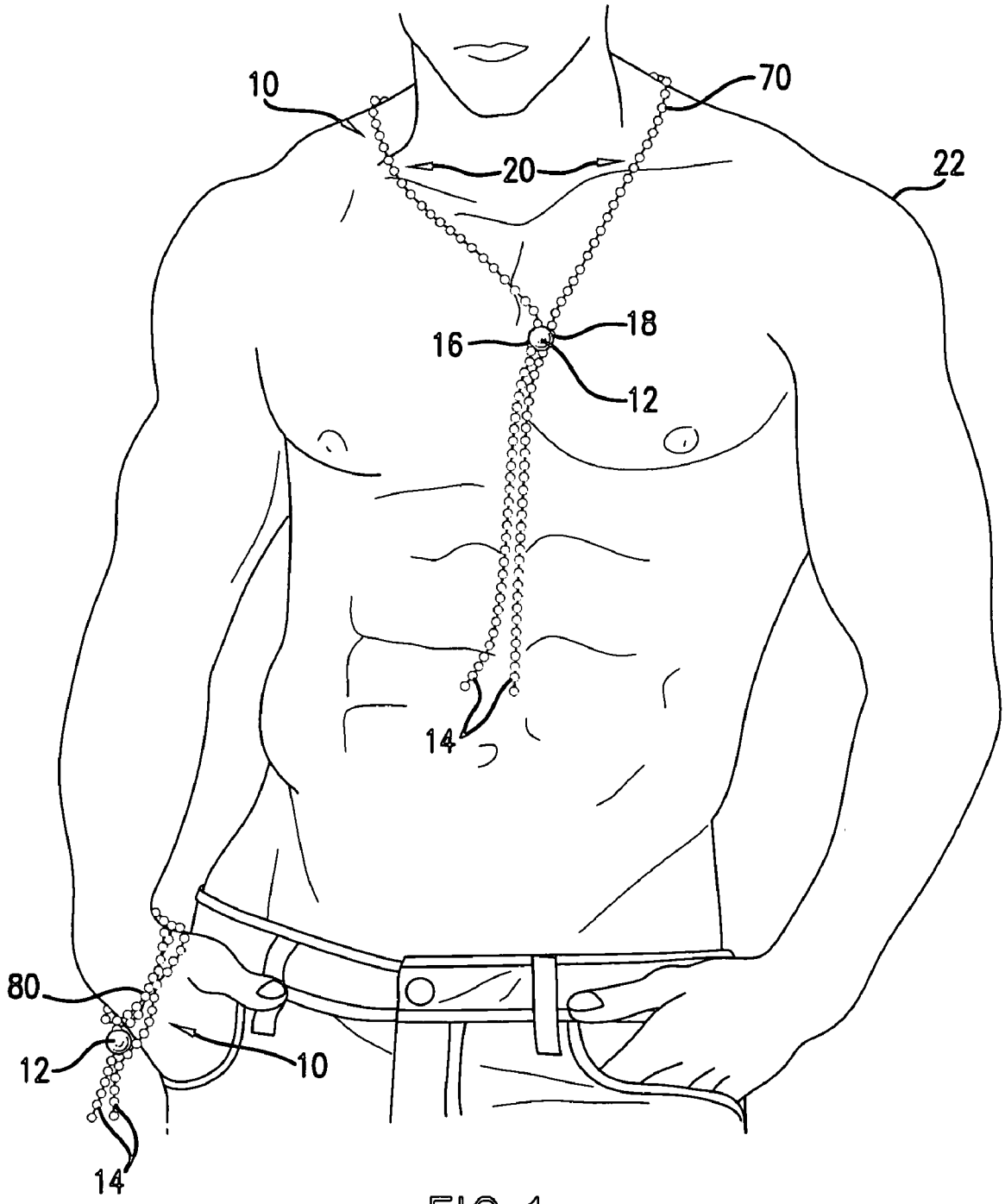
FIG. 1 shows a perspective view of the jewelry forming article in an extended position, where the loop formed by engagement regions allows for securing the article to the body of a person in the form of a necklace and wristband according to embodiments of the invention.

Referring initially to FIG. 1, there is illustrated a representative view of the jewelry forming article shown in the an extended position in accordance with the invention, generally designated as 10. The jewelry forming article, 10, comprises a magnetic body 12, such as a permanent magnet which may be formed from alnicos, hard ferrites, and rare earth magnets. Further, the magnetic body, 12, may be configured for disposition of indicia or a precious stone. In a related aspect, the magnetic body magnetically engages the indicia or precious stone, where the indicia or precious stone, for example, is mounted/set on material which is attracted to the magnetic body (see, e.g., U.S. Pat. No. 4,052,864). In another related aspect, the indicia may be permanently affixed to the magnetic body, for example, by printing, imprinting, or etching. Further, such indicia include, but are not limited to, characters, patterns, or designs.

In one embodiment, the magnetic body, 12, is made from neodymium-iron-boron and/or samarium cobalt. In a related aspect, the surfaces of the magnetic body may define a standard or irregular geometric solid. For example, the geometric solid includes, but is not limited to, a sphere, a cube, a cylinder, a cone, a prism, a pyramid, a tetrahedron, an octahedron, and a dodecahedron. In one aspect, the surfaces of the magnetic body, 12, define a sphere. In a related aspect, the sphere may range in size from about 0.2 cm in diameter to about 2.5 cm in diameter.

The article, 10, further comprises a deformable chain, 14, where the magnetic body magnetically engages the chain, 14, at various engagement regions, 16,18, along the length of the chain, 14. The chain, 14, can be of variable thicknesses, lengths, and styles so as to produce various size loop circumferences, 20. In a related aspect, the chain styles may include, but are not limited to, ball chains, solid anchor chains, box chains, popcorn chains, cable chains, solid curb chains, FIG. 8 chains, solid Figaro chains, Singapore chains, round rope chains, snake chains, wheat chains, diamond cut wheat chains, bead chains, and Parisian wheat chains. In another related aspect, where chains may comprise links that consist essentially of non-magnetic material (e.g., glass beads), such links may include a material that is attracted to the magnetic body (e.g., ferrous metal embedded therein).

Figure 6:
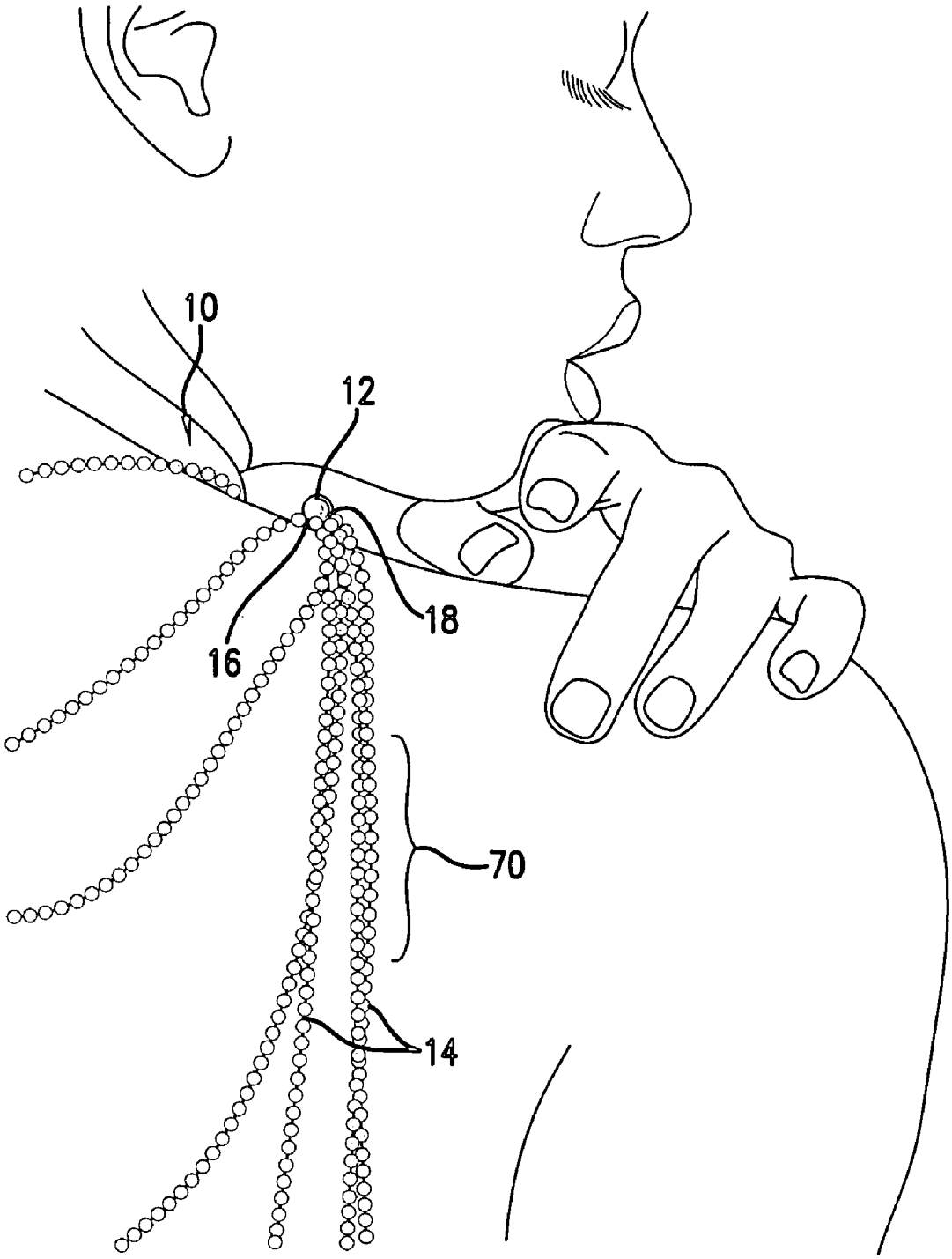
FIG. 6 shows another view of the article secured to the body of a person configured to be worn as a necklace, including draping of non-engaging regions, according to an embodiment of the invention.

In one aspect, the chain, 14, may include separated engagement and non-engagement regions, where, for example, the non-engagement regions drape between the engagement regions (FIG. 6). In another aspect, such non-engagement regions may comprise material in which atoms remain randomly oriented when exposed to a magnet, and thus, are not attracted to the magnetic body, 12. Further, such material may include, but is not limited to, a non-ferrous metal, wood, glass, plastic, or a combination thereof. Moreover, a chain, 14, can be configured to be opened or closed.

Figure 2:
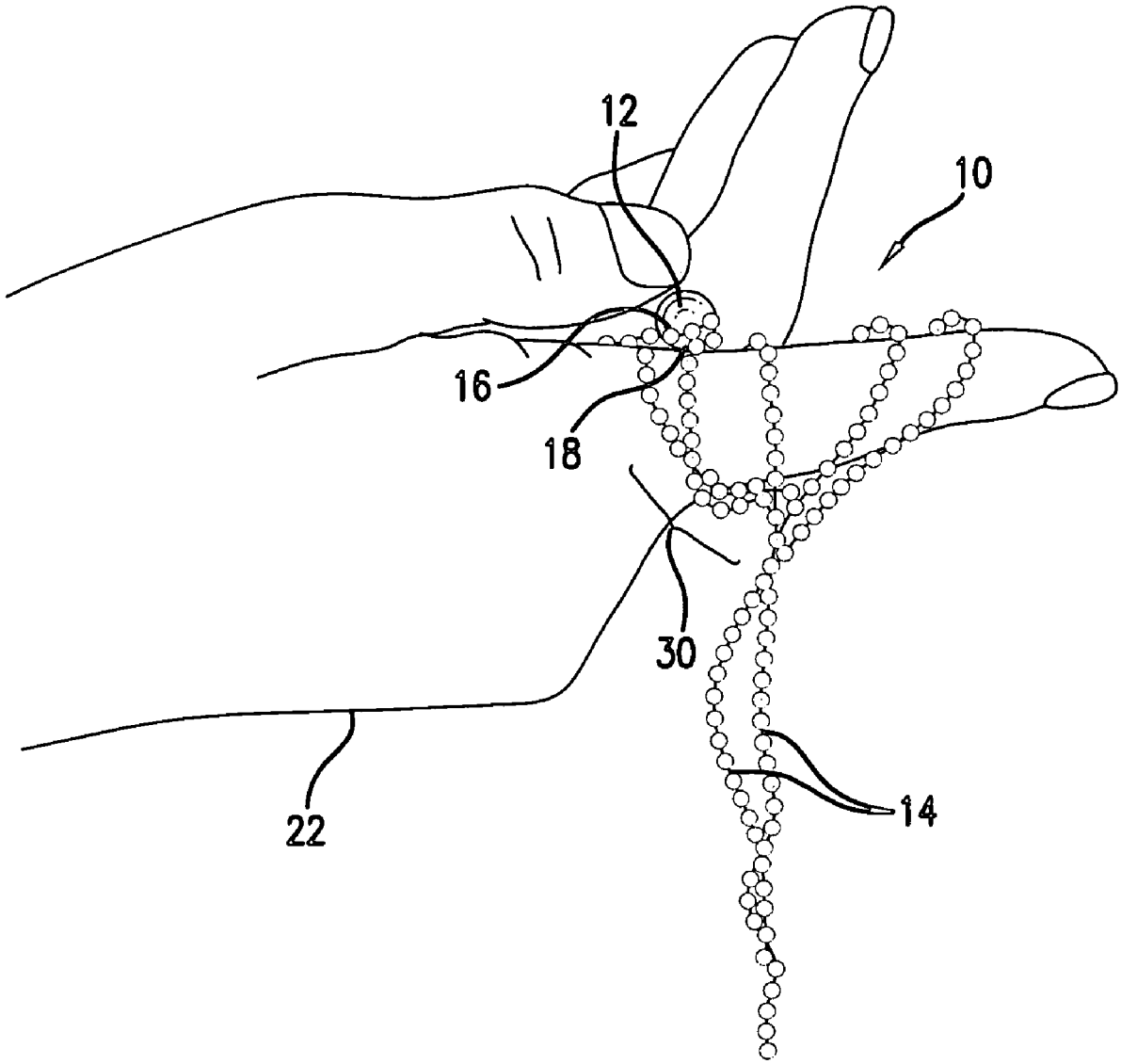
FIG. 2 shows the article, secured to the body of a person configured to be worn as a ring according to an embodiment of the invention.
Figure 3:
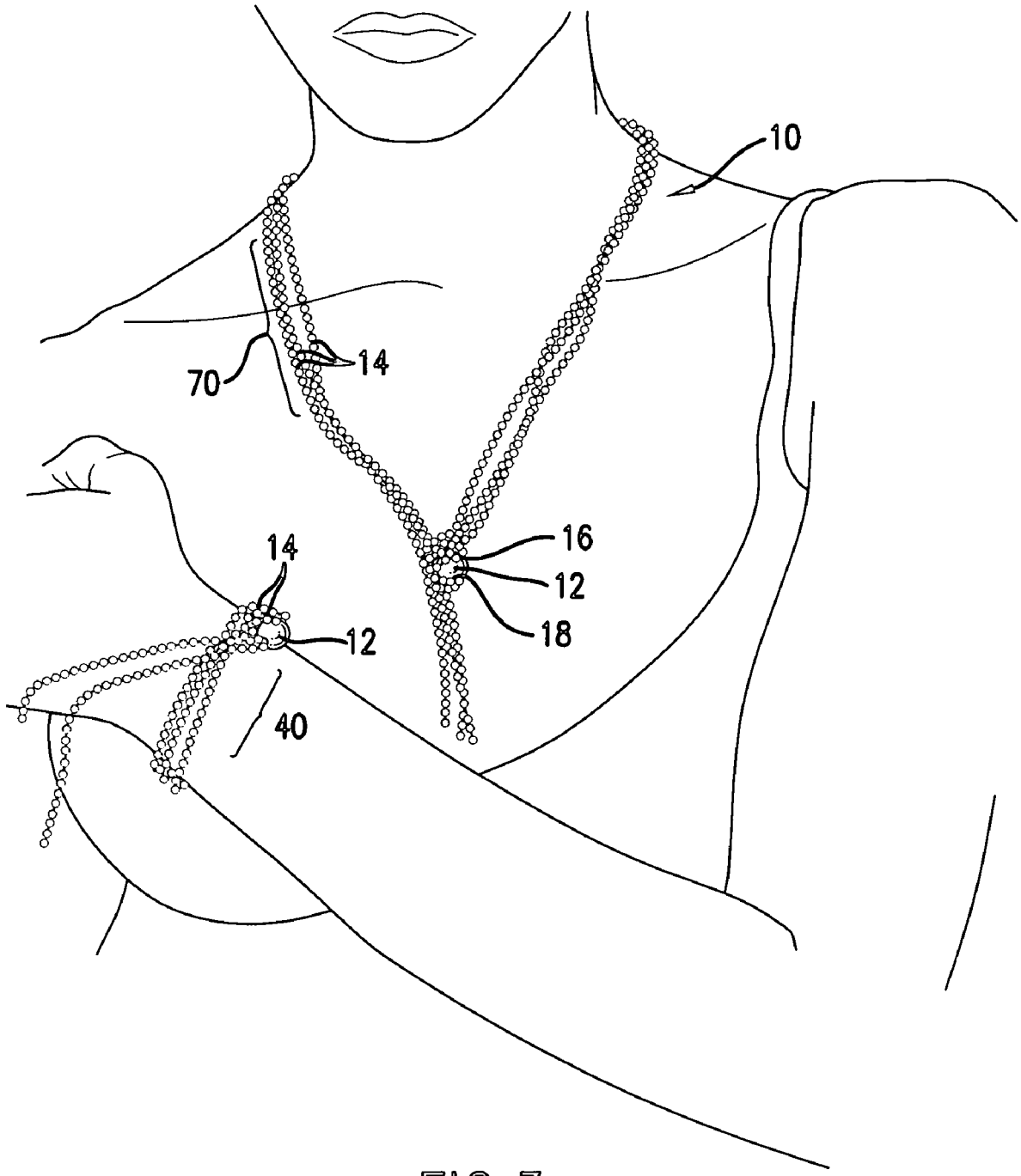
FIG. 3 shows the article secured to the body of a person configured to be worn as a bracelet and a necklace having multiple chains according to embodiments of the invention.
Figure 4:
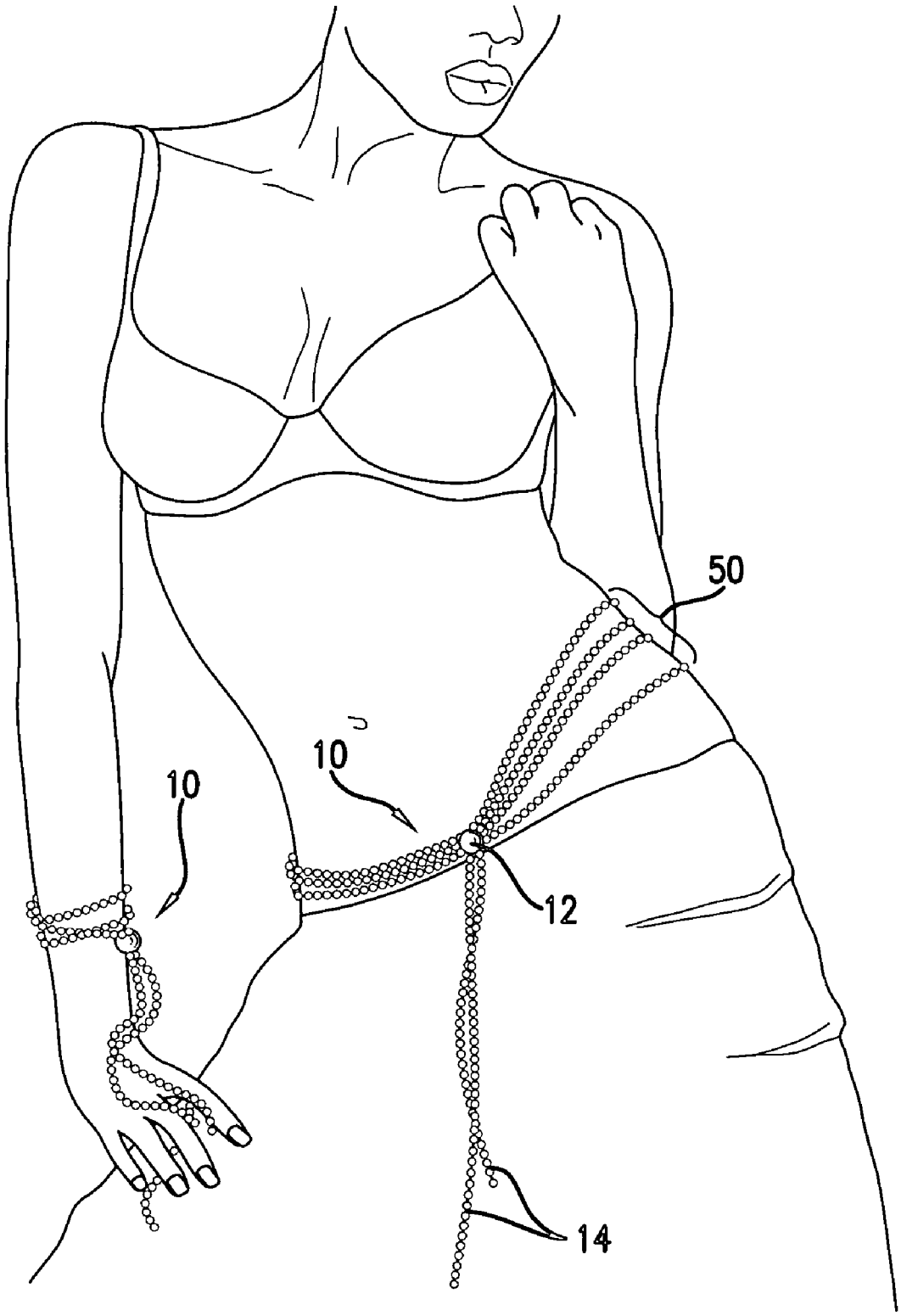
FIG. 4 shows the article secured to the body of a person configured to be worn as a body chain according to an embodiment of the invention.
Figure 5:
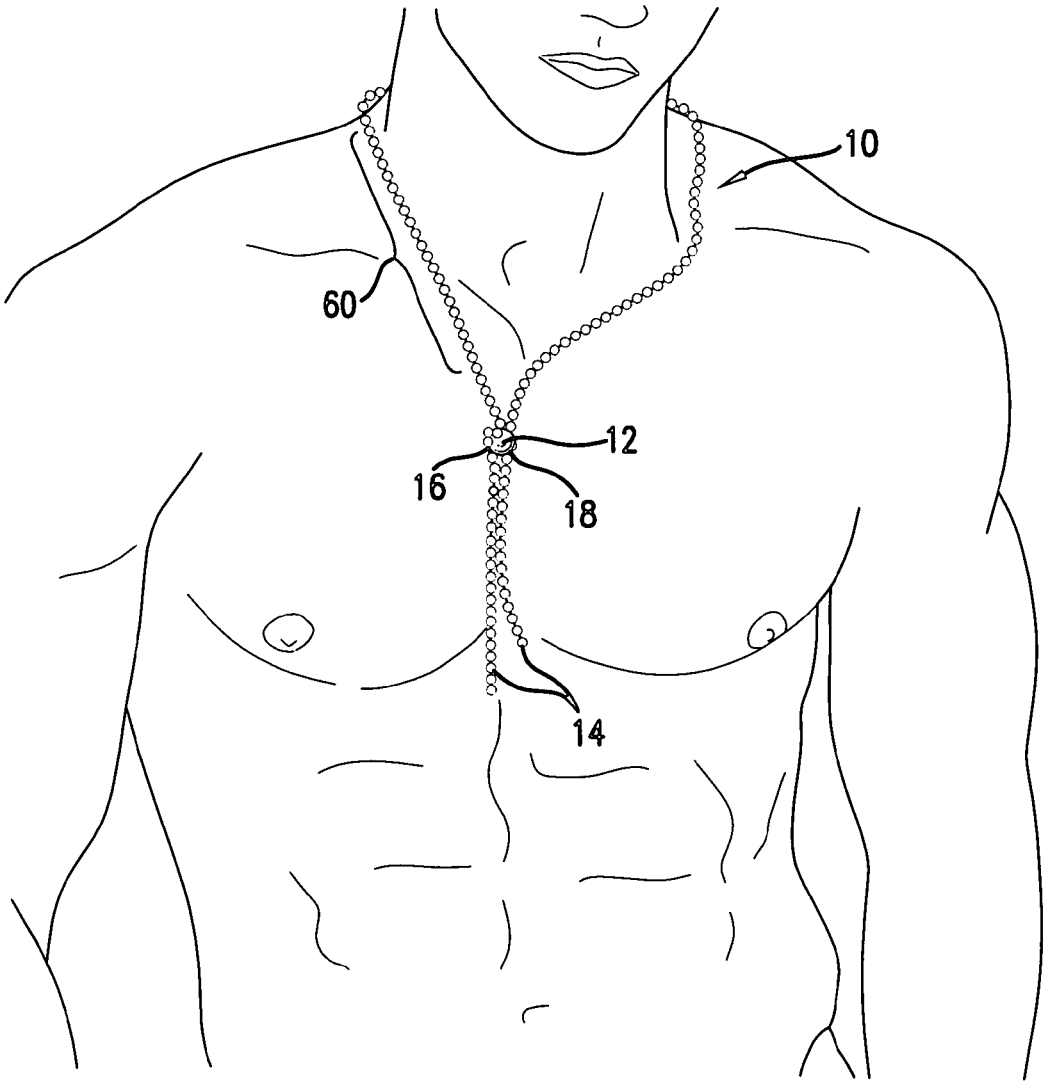
FIG. 5 shows the article secured to the body of a person configured to be worn as a choker according to an embodiment of the invention.
Figure 7:
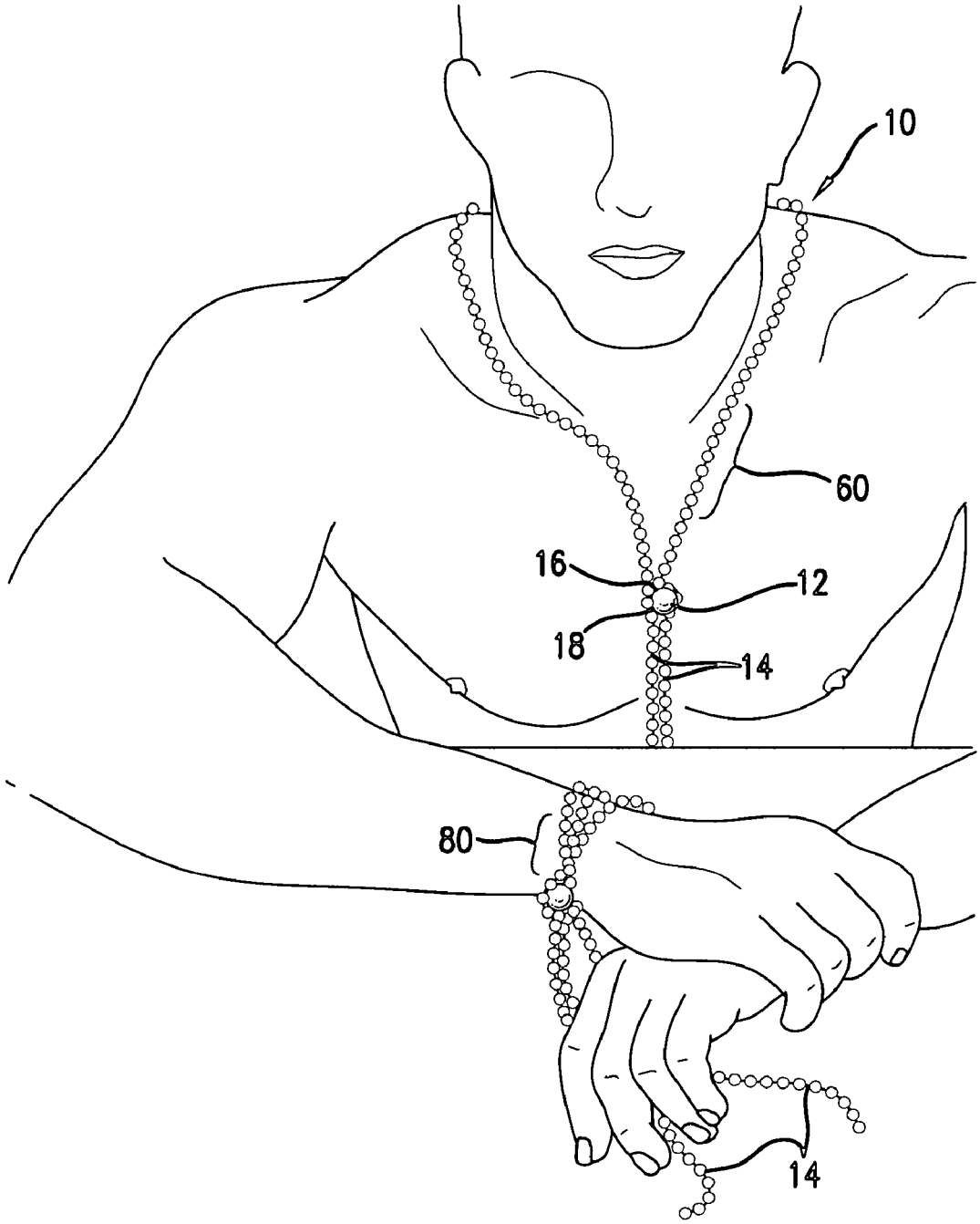
FIG. 7 shows another view of the article secured to the body of a person configured to be worn as a wristband and a choker according to embodiments of the invention.

In one embodiment, the surfaces of the magnetic body, 12, engage at least two regions, 16,18, along the length of the chain, 14, to form at least one loop circumference, 20, thus these engaging regions set a particular loop circumference. In a related aspect, the circumference of the loop, 20, may be increased or decreased by changing the regions of engagement of the free magnetic body, 12, along the length of the chain, 14. In another related aspect, the loop circumference may be increased or decreased to enable a person to secure the article on his or her body in the form of various jewelry objects, including, but not limited to, a ring, 30 (FIG. 2), bracelet, 40 (FIG. 3), anklet, body chain, 50 (FIG. 4), choker, 60 (FIG. 5), necklace, 70 (FIG. 6), wristband, 80 (FIG. 7), or combinations thereof.

In one aspect, the jewelry forming article, 10, includes one or more adornments, where the adornment is configured to releasably attach to the magnetic body, 12, and/or the chain length, 14. Such adornments may include, but are not limited to, precious stones, charms, indicia, and part of a character, pattern, or design. In another aspect, the article may include multiple free magnet bodies, multiple chain lengths, and multiple adornments. Further, the article may comprise multiple colors.

In one embodiment, a jewelry forming article may be worn in a variety of configurations by using a method including magnetically engaging one or more surfaces of the free magnetic body, 12, to two or more regions, 16,18, along a length of the free chain, 14, and forming at least one loop circumference, 20, between the engaged regions, 16,18, where at least one loop circumference, 20, enables a person, 22, to secure the article, 10, on the body of the person, 22. In a related aspect, by changing the engagement regions, 16,18, along the chain length, 14, the loop circumference, 20, may be increased or decreased to enable a person to secure the article on his or her body in the form of a ring, bracelet, anklet, chain, choker, necklace, wristband, or combinations thereof. In a related aspect, this method of wearing the various configurations of the article may be carried out with multiple free magnet bodies, multiple chain lengths, and multiple adornments.

Although the invention has been described with reference to the above examples, it will be understood that modifications and variations are encompassed within the spirit and scope of the invention. Accordingly, the invention is limited only by the following claims.

What is claimed is:

1. A jewelry-forming article comprising:

a first component comprising a free magnetic body; and a second component comprising a free deformable chain, said chain being formed from a plurality of mechanically interconnected segments;

wherein said magnetic body is mechanically free from said chain and is magnetically engageable with a plurality of regions along a length of said chain simultaneously to form at least one loop to define a circumference, each of the plurality of regions being spaced apart from a first end of the chain and a second end of the chain, wherein the circumference of said loop may be increased or decreased by changing the regions at which the free magnetic body is engaged along the length of the chain, thereby enabling a person to secure said article on a body of a person.

2. The article of claim 1, wherein said magnetic body is in a shape of a standard geometric solid.

3. The article of claim 2, wherein said geometric solid is selected from the group consisting of a sphere, a cube, a cylinder, a cone, a prism, a pyramid, a tetrahedron, an octahedron, and a dodecahedron.

4. The article of claim 1, wherein said magnetic body is in a shape of an irregular geometric solid.

5. The article of claim 1, wherein said magnetic body is in a shape of a sphere.

6. The article of claim 1, wherein the one or more regions are changeable to form a ring, bracelet, anklet, chain, choker, necklace, wristband, or combinations thereof.

7. The article of claim 1, wherein said chain comprises separated engagement and non-engagement regions, and wherein said non-engagement regions are operable to drape between said engagement regions.

8. The article of claim 1, wherein indicia or a precious stone is disposed on said magnetic body.

9. The article of claim 1, further comprising at least one adornment selected from the group consisting of precious stones, charms, indicia, and part of a character, part of a pattern, and part of a design; and wherein said adornment is configured to releasably attach to said one or more magnetic body and/or said chain length.

10. The article of claim 1, wherein said magnetic body comprises iron, nickel, cobalt, or a combination thereof.

11. The article of claim 1, wherein said chain length is opened.

12. The article of claim 1, wherein said chain length comprises intermittent portions comprising material which is attracted to said magnetic body.

13. The article of claim 12, wherein said chain lengths further comprise intermittent portions comprising material in which atoms remain randomly oriented when exposed to a magnet.

14. The article of claim 13, wherein said material is a non-ferrous metal, wood, plastic, glass, or a combination thereof.

15. A jewelry-forming article comprising at least two separate components, said article comprising a first component comprising a free magnetic body and a second component comprising at least one free deformable chain length formed from a plurality of mechanically interconnected segments, wherein said magnetic body is mechanically free from said chain, wherein one or more surfaces of said magnetic body magnetically simultaneously engage a plurality of portions of said chain length to form at least one loop defining a circumference, said plurality of portions being spaced apart from a first end of said chain length and a second end of said chain length, wherein the circumference of said loop may be increased or decreased by changing the regions at which the free magnetic body is engaged along the length of the chain, and wherein the surfaces of said magnetic body define a standard or irregular geometric solid.

16. A method of wearing a jewelry article comprising:

magnetically engaging at least one free magnetic body to two or more spaced apart regions along a length of at least one free deformable chain simultaneously, the chain being formed from a plurality of mechanically interconnected segments and the magnetic body being mechanically free from said chain, each of the spaced apart regions being spaced apart from a first end of the chain and the second end of the chain in addition to being spaced apart from each other, thereby forming at least one loop along a length of the chain, the loop defining a circumference; and changing the circumference of said at least one loop by changing the regions at which the free magnetic body is engaged along the length of the chain;

wherein said at least one loop enables a person to secure the article on a body of the person.

17. The method of claim 16, further comprising:

forming separated engagement and non-engagement regions in said chain length;

wherein non-engagement regions drape between separated engagement regions.

18. The method of claim 17, wherein said non-engagement regions comprise material in which atoms remain randomly oriented when exposed to a magnet.

19. The method of claim 18, wherein said material comprising the non-engagement regions is a non-ferrous metal, wood, plastic, glass, or a combination thereof.

20. The method of claim 16, wherein the jewelry article is worn as a ring, bracelet, anklet, chain, choker, necklace, wristband, or combinations thereof.

21. The method of claim 16, wherein said magnetic body is in a shape of a standard geometric solid.

22. The method of claim 21, wherein said magnetic body is in a shape of a sphere.

* * * * *

UNITED STATES PATENT AND TRADEMARK OFFICE

CERTIFICATE OF CORRECTION

PATENT NO. : 7,654,112 B2
APPLICATION NO. : 11/493674
DATED : February 2, 2010
INVENTOR(S) : Luis G. Pons It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 755 days.

Signed and Sealed this

Twenty-third Day of November, 2010

David J. Kappos

David J. Kappos
*Director of the United States Patent and Trademark Office*